US006384739B1

(12) United States Patent
Roberts, Jr.

(10) Patent No.: US 6,384,739 B1
(45) **Date of Patent: *May 7, 2002**

(54) TRAFFIC MONITORING SYSTEM AND METHOD

(75) Inventor: Evans V. Roberts, Jr., Woodstock, GA (US)

(73) Assignee: Bellsouth Intellectual Property Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/309,185

(22) Filed: May 10, 1999

(51) Int. Cl.[7] ..... G08G 1/09; G06M 7/00

(52) U.S. Cl. ..... 340/905; 340/928; 340/933; 701/117; 368/6; 377/9

(58) Field of Search ..... 340/905, 933, 340/934, 928; 701/117, 118; 708/109; 368/6, 13; 377/9, 13

(56) References Cited

U.S. PATENT DOCUMENTS

| | | | | |
|---|---|---|---|---|
| 4,985,705 A | | 1/1991 | Stammler | 342/69 |
| 5,131,020 A | | 7/1992 | Liebesny et al. | 379/59 |
| 5,182,555 A | | 1/1993 | Sumner | 340/905 |
| 5,289,183 A | | 2/1994 | Hassett et al. | 340/905 |
| 5,317,311 A | | 5/1994 | Martell et al. | 340/905 |
| 5,396,429 A | | 3/1995 | Hanchett | 340/910 |
| 5,402,117 A | | 3/1995 | Zijderhand | 340/905 |
| 5,523,950 A | | 6/1996 | Peterson | 340/905 |
| 5,526,401 A | | 6/1996 | Roach, Jr. et al. | 379/59 |
| 5,539,645 A | | 7/1996 | Mandhyan et al. | 340/905 |
| 5,539,810 A | | 7/1996 | Kennedy, III et al. | 379/59 |
| 5,544,225 A | | 8/1996 | Kennedy, III et al. | 379/59 |
| 5,559,864 A | | 9/1996 | Kennedy, Jr. | 379/58 |
| 5,572,450 A | * | 11/1996 | Worthy | 701/118 |
| 5,699,056 A | | 12/1997 | Yoshida | 340/905 |
| 5,732,383 A | | 3/1998 | Foladare et al. | 701/117 |
| 5,745,865 A | | 4/1998 | Rostoker et al. | 701/117 |
| 5,812,069 A | | 9/1998 | Albrecht et al. | 340/905 |
| 5,889,477 A | * | 3/1999 | Fastenrath | 340/905 |

FOREIGN PATENT DOCUMENTS

| | | |
|---|---|---|
| DK | 19604084 | 2/1996 |
| WO | WO9607110 | 7/1996 |

* cited by examiner

*Primary Examiner*—Donnie L. Crosland
(74) *Attorney, Agent, or Firm*—Michael J. Turton; James L. Ewing, IV; Kilpatrick Stockton LLP

(57) ABSTRACT

The system provides a method for gathering and sending monitored traffic data via a short messaging system message over a wireless network through a publicly switched telephone network ("PSTN") to a central computer. A remote traffic monitoring unit acts as a data collection device collecting data regarding the traffic count and other conditions at its particular location. The remote traffic monitoring unit can monitor different types of traffic—for example, motor vehicles, trains, and pedestrians. The system routes data messages including monitored traffic count data from the remote traffic monitoring unit to a central computer and routes control information from the central computer to the remote traffic monitoring unit. The system maintains and processes count data of traffic at a remote location and is capable of collecting the count data including a remote traffic monitoring device adapted to gather traffic count data, formatting the traffic count data into a short message service message, and transmitting the short message service message via a wireless transmission; comprising a central computer for receiving the traffic count data from the remote traffic monitoring device.

24 Claims, 4 Drawing Sheets

TRAFFIC MONITORING SYSTEM AND METHOD

FIELD OF INVENTION

This invention relates to a traffic monitoring system and method. More particularly, this invention relates to a traffic monitoring system and method utilizing wireless communications to provide traffic information.

BACKGROUND OF THE INVENTION

Increased traffic congestion is an ever increasing problem in major urban areas. Traffic congestion has an adverse effect on the environment and adds stress to peoples' daily lives. It is important that traffic engineers have accurate information regarding traffic. Accurate traffic information allows traffic engineers to pin point problem areas, find long term solutions to traffic problems, and provide drivers with accurate near real time information to avoid problems. Several traffic monitoring systems and methods currently exist.

Some of the current traffic monitoring systems are crude stand alone devices that merely count the number of cars that pass over a sensor. In order to gather any information from these devices a person must go out to the device and read the counter at the location, or take the device from the location where the counter can be read. Such devices do not provide real time information. Moreover, such devices do not provide any sort of error detection to alert traffic engineers if the device is malfunctioning.

Other traffic monitoring systems are configured to provide real time or near real time information. Such systems typically comprise remote traffic monitoring units that communicate in some way with a central station. In some of the prior art systems the remote units are hardwired, such as through telephone lines, to a central station. As such, the remote units of these systems are typically permanently fixed to a location and are not easily moved. These devices are typically "dumb" monitoring devices with no localized processing capability. Moreover, these devices typically do not monitor roadway temperature or other roadway conditions and do not have the capability to record traffic for specified pre-determined periods.

Some prior art systems exist that utilize cellular or radio transmission to communicate from the remote monitoring devices to a central station. With these cellular systems, the voice channels are typically used to transmit monitored data. Such systems use up valuable space on the voice channels and depending on the size of the system may require additional capacity to be added to the cellular system. The systems that utilize radio transmission require that a radio network be built to accommodate the system. As such, both of these methods of transmission are expensive to implement.

SUMMARY OF THE INVENTION

The present invention overcomes the above problems by providing a system and method for gathering and sending monitored traffic data via a short messaging system message over a wireless network through a publicly switched telephone network ("PSTN") to a central computer. A remote traffic monitoring unit acts as a data collection device collecting data regarding the traffic count and other conditions at its particular location. The remote traffic monitoring unit can monitor different types of traffic—for example, motor vehicles, trains, and pedestrians. The system routes data messages including monitored traffic count data from the remote traffic monitoring unit to a central computer and routes control information from the central computer to the remote traffic monitoring unit.

A system of the present invention for maintaining count data of traffic at a remote location and capable of collecting the count data includes a remote traffic monitoring device adapted to gather traffic count data, format the traffic count data into a short message service message, and transmit the short message service message via a wireless transmission; and a central computer for receiving the traffic count data from the remote traffic monitoring device.

A remote traffic monitoring device of the present invention includes a first object sensing device adapted to generate a signal representing the presence of the object; a first counting device coupled to the object sensing device, the counting device adapted to maintain count data, receive the signal representing the presence of the object from the sensing device, and increment the count data for each signal received from the sensing device; a processor coupled to the counting device, the processor adapted to receive the count data from the counting device and assemble the count data in a short message service message; and a wireless telephone transceiver coupled to the processor, the transceiver adapted to receive the short message service message from the processor and transmit the short message service message. In the preferred embodiment, the transceiver is a Personal Communication System transceiver. The remote monitoring device can also include a temperature sensing device to generate temperature data to be included in the short messaging service message. The remote monitoring device can also include a water level monitoring device to generate water level data to be included in the short messaging service message.

A method of the present invention for collecting traffic count data within a system having a remote traffic monitoring device and a central computer includes sensing the presence of an object to be counted; generating a signal representative of the sensing of the object; incrementing traffic count data upon the detection of the signal; and formatting traffic count data into a short message service format. The method can also include transmitting the short message service message to the central computer.

DETAILED DESCRIPTION

System Overview

Figure 1:
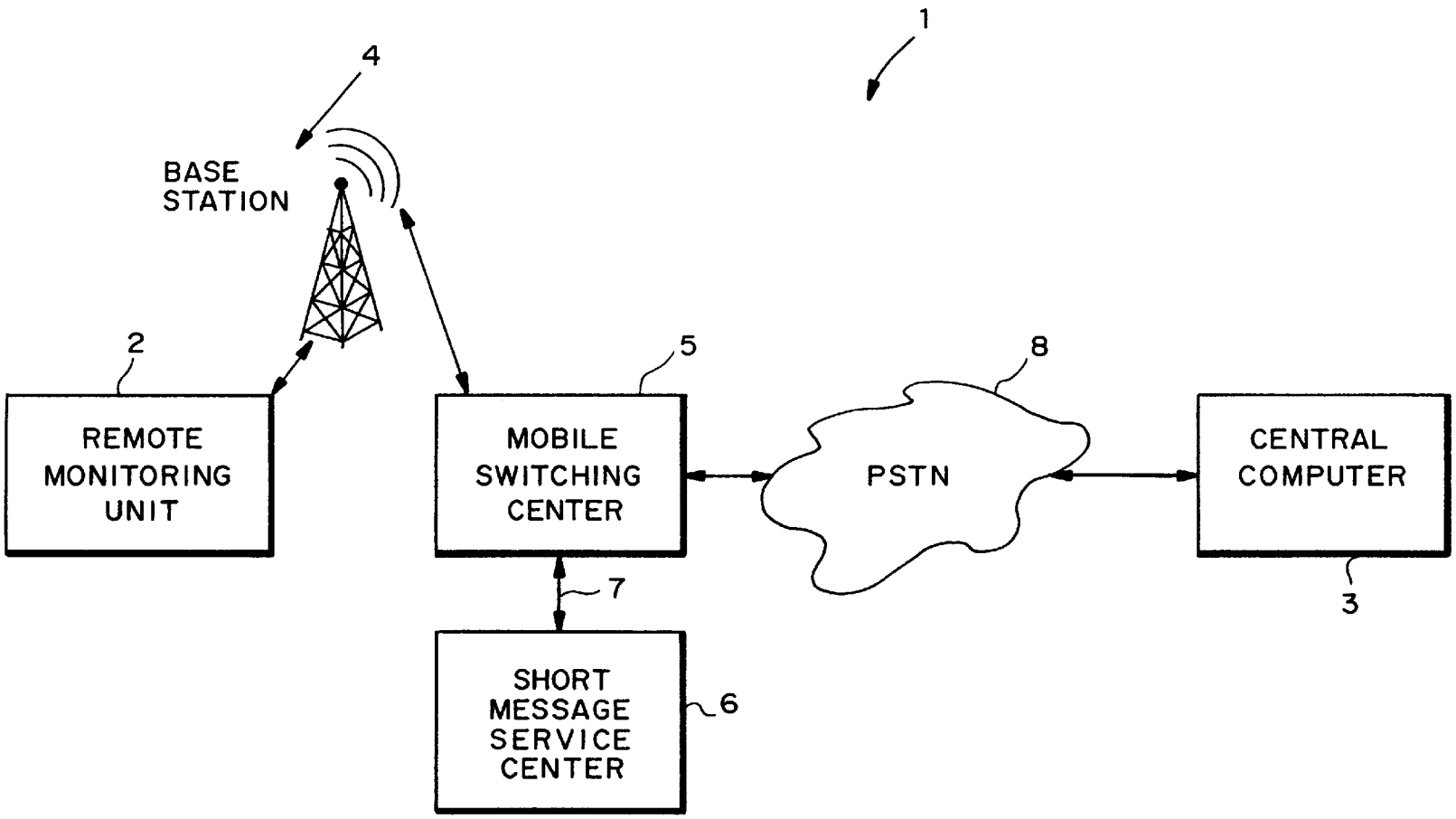
FIG. 1 shows a block diagram of a system according to the present invention.

FIG. 1 illustrates one exemplary embodiment of the traffic monitoring system. A remote traffic monitoring unit 2 acts as a data collection device collecting data regarding the traffic count and other conditions at its particular location, as defined below. The remote traffic monitoring unit 2 can monitor different types of traffic—for example, motor vehicles, trains, and pedestrians. The system routes data messages including monitored traffic count data from the remote traffic monitoring unit 2 to a central computer 3 and routes control information from the central computer 3 to the remote traffic monitoring unit 2. While FIG. 1 shows one remote traffic monitoring unit 2, many remote traffic monitoring units could be connected to the system 1.

The remote traffic monitoring unit 2 formats monitored data and other data for transmission via a wireless digital communications network, such as a Personal Communications System ("PCS") network. In one embodiment, the PCS network has data messaging capability, such as a Global System for Mobile Communications ("GSM"), Time Division Multiple Access ("TDMA") system, or Code Division Multiple Access ("CDMA") system. A GSM, TDMA, or CDMA system has the capability to receive short data messages with its Short Messaging Service ("SMS"). GSM SMS provides for 160 7-bit ASCII characters data messages that are transmitted on the control channel of the GSM. TDMA SMS provides for 255 7-bit ASCII characters data messages. CDMA SMS provides for 191 7-bit ASCII characters data messages. As such, data can be transmitted via the SMS without utilizing capacity on the crowded voice channels.

The remote traffic monitoring unit 2 transmits the data message to a base station 4 and appropriate equipment for receiving and transmitting wireless voice and data messages. The remote traffic monitoring unit 2 can also receive data transmitted to it from the base station 5.

The base station 5 transmits voice and data signals to a Mobile Switching Center ("MSC") 5. If the data is an SMS message, the MSC 5 switches the SMS message to a Short Message Service Center ("SC") 6. The SC 6 may be co-located with the MSC 5 or may be coupled to the MSC 5 via a communications link, 7 as shown in FIG. 1. The SC 6 routes SMS messages to the appropriate destination and confirms the receipt of the SMS messages. Additionally, the SC 6 receives outgoing SMS messages and reformats those messages for transmission through the MSC 5.

The MSC 5 is connected to a Public Switched Telephone Network ("PSTN") 8 and the MSC 5 is thus capable of receiving data and voice signals from and transmitting data and voice signals to the PSTN 8.

The central computer is connected to the PSTN 8 and receives and stores monitored data from all associated remote traffic monitoring units. The central computer 3 may be a server or personal computer and may be connected to the PSTN 8 via a modem, ISDN line, or any other method known to those skilled in the art. A user of the central computer 3 can access the monitored and other data from the messages sent by the remote traffic monitoring unit 2.

Remote Traffic Monitoring Unit Overview

Figure 2:
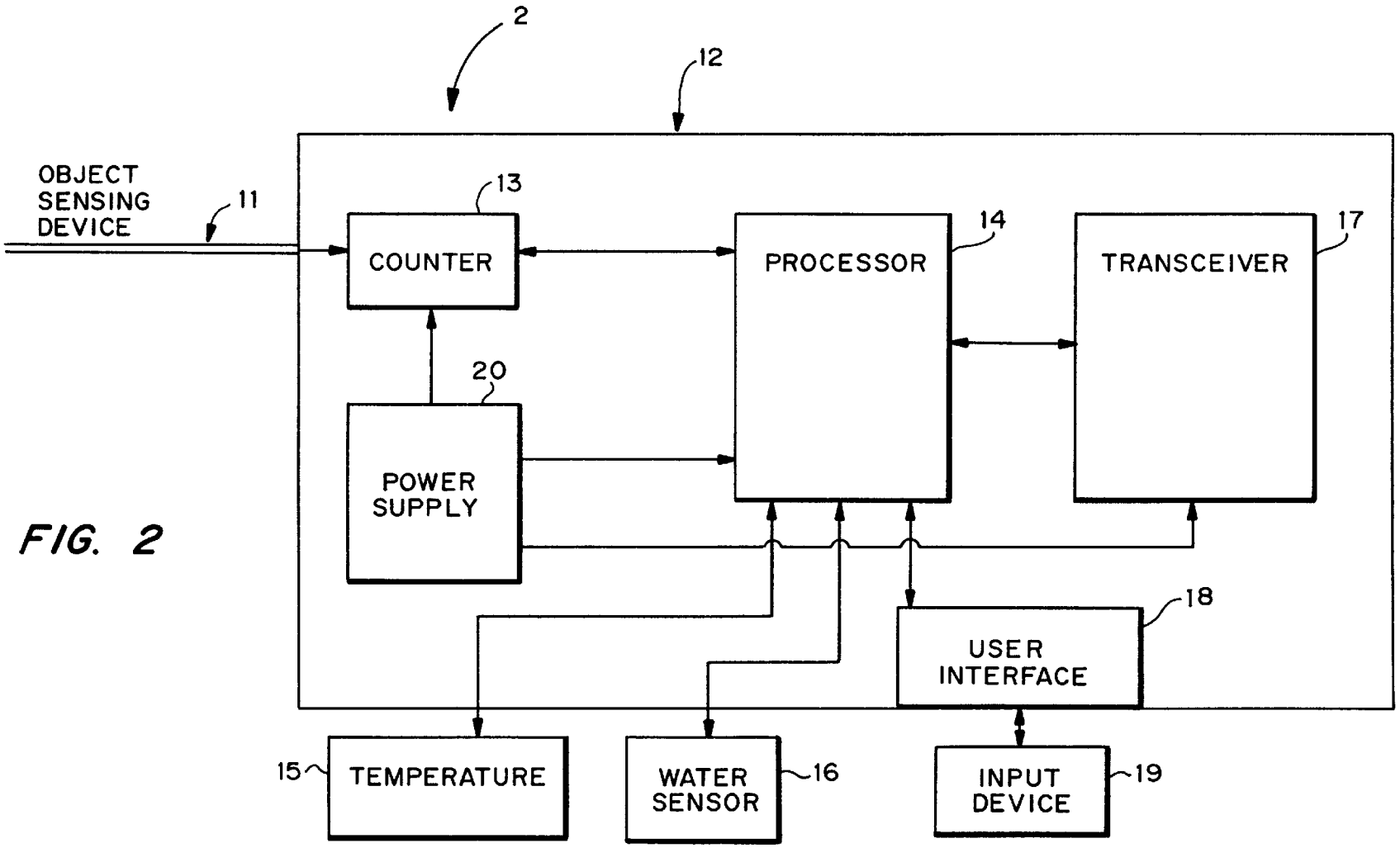
FIG. 2 shows a block diagram of one embodiment of the remote traffic monitoring unit.

FIG. 2 provides a more detailed illustration of the remote traffic monitoring unit 2. An object sensing device 11 is connected to a monitoring unit base 12. The object sensing device 11 can be any type of sensing device, known to those skilled in the art, for sensing the presence of an object—for example, pressure sensitive monitoring strips, photo-optic triggers, or proximity detectors. Upon determining the presence of an object, the object sensing device 11 generates an appropriate signal. Inside the base 12, the object sensing device 11 is connected to a counter 13. The counter 13 maintains count data and could be an incremental cumulative counter. The count data is the current count of signals generated by the object sensing device 11. The counter 13 increments the count data when receiving the appropriate signal from the sensing device 11. A processor 14 is connected to the counter 13 for receiving and storing the count data from the counter 13 and providing control information to the counter 13. While FIG. 2 shows one object sensing device and one associated counter, the remote monitoring unit could include multiple object sensing devices and associated counters.

The remote traffic monitoring unit 2 can also include other sensing devices such as a temperature sensor 15 and a water level sensor 16. These other sensing devices can be integral with the object sensing devices 11 or can be separate. The temperature sensor 15 may monitor outside air temperature or may be positioned to monitor roadway or train rail temperature. The temperature sensor 15 maintains temperature data reflecting the temperature being monitored. The water level sensor 16 may monitor the water level of a roadway or other location. The water level sensor 16 maintains water level data reflecting the water level being monitored. The processor 14 is coupled to the temperature sensing device 15 and the water level sensing device 16 to receive and store temperature data and water level data and provide control information to the temperature sensing device 15 and water level sensing device 16.

The remote traffic monitoring unit 2 could include an internal power supply 20 or an interface to an external power supply (not shown in FIG. 1). The power supply 20 could be coupled to and provide power to the counter 13, the processor 14, the transceiver 17, and any other device. The remote traffic monitoring unit 2 could further include error detection sensors, such as a battery voltage level sensor (not shown) and a system disconnect sensor (not shown). The battery voltage sensor monitors the internal power supply 20 of the remote traffic monitoring unit 2 to provide data sufficient to warn of low battery power or battery malfunction. The system disconnect sensor monitors disconnection from external sensors, a/c power sources, and any other external connections.

Additionally, the processor 14 may store user defined data—for example, the location of the remote traffic monitoring unit, the data of installation of the remote traffic monitoring unit, and the name of the installer of the unit. This data is provided by a user at setup or reinitialization of the remote traffic monitoring unit 2. The processor 14 may also store the remote traffic monitoring unit's 2 model number and serial number. This data is permanent and may be stored in the processor 14 permanently. The polling method in which the processor reads the monitored data may also be stored by the processor 14. The processor 14 can read the monitored data at predetermined intervals or at an unscheduled time. Data relevant for error detection such as, unit status data and unauthorized disconnect data may be stored by the processor 14. In addition, data and time data is maintained by the processor 14. This date and time data may be provided internally by the processor 14, may be provided from an external real time clock (not shown) connected to the processor 14, or may be provided by a remote wireless time standard stamp.

In one embodiment, the processor 14 stores the user defined data and the non-user defined data including monitored data (e.g. count data, temperature data, water level data, and battery condition data) in predetermined storage locations, such as registers. In another embodiment, the processor 14 is coupled to external memory that stores the data described above in predetermined memory locations. The processor 14 may be an ultra low power 8 bit unit, such as from Cool Risc™.

The processor 14 is coupled to a transceiver 17 and can forward its stored data to the transceiver 17. Before forwarding the data, the processor 14 formats the stored data from the predetermined storage locations into a predetermined data stream structure preferably SMS format. Alternatively, multiple SMS messages may be transmitted sequentially to increase data transfer between the remote monitoring unit 2 and the central computer and vice-versa.

Examples of the user defined data fields and the non-user defined data fields for a single SMS message are shown below in Tables 1 and 2 respectively.

TABLE 1

| User Defined Data Fields | |
|---|---|
| 1. | Location of device |
| 2. | Date of installation |
| 3. | Installer's Name |
| 4. | Un-Designated |
| 5. | Un-Designated |
| 6. | Un-Designated |

TABLE 2

| Non-User Defined Data Fields | |
|---|---|
| 1. | Remote traffic monitoring unit 2 Model Number and Serial Number |
| 2. | Battery conditions |
| 3. | Ambient Temperature |
| 4. | Polling method |
| 5. | Unit status (results of self-diagnostic checks); |
| 6. | Unauthorized system disconnect (vandalism or theft detection); |
| 7. | Count data |
| 8. | Date and time |

In the above example, user defined data fields 4–6 of Table 1 are undesignated, but can be used for additional data as necessary.

The transceiver 17 is preferably a PCS type transceiver, such as TDMA, CDMA, or GSM. The transceiver 17 transmits the SMS data messages received from the processor and receives control information from the central computer 3 via the base station as shown in FIG. 1.

Additionally, the remote traffic monitoring unit 2 can include an interface 18 connected to the processor 14 for connecting an input device 19 for setting up or reinitializing the remote monitoring device 2. The input device 19 can be an integral part of the remote traffic monitoring unit 2, such as keypad with a display affixed to the unit, or the input device 19 can be separate from the remote traffic monitoring unit 2 and connected as necessary to the unit. The input device 19 allows a user to input user defined data into the remote traffic monitoring unit such as the location of the unit, the date installed, and the name of the installer, as indicated in the user defined data table above. Further, the input device allows a user to reprogram the processor 14.

Remote Traffic Monitoring Unit Operation

The remote traffic monitoring units 2 can be placed in any location necessary to monitor traffic and can be used to monitor a variety of types of traffic, such as motor vehicles, trains, pedestrians, etc. In the embodiment described below the remote traffic monitoring unit 2 monitors motor vehicle traffic, but one skilled in the art would understand how to use the remote traffic monitoring unit 2 to monitor other types of traffic.

For motor vehicle traffic, traffic engineers could select key areas throughout the city to place the remote traffic monitoring units, 2 if it is desired to monitor the motor vehicle traffic of the entire city. Alternatively, traffic engineers could put the remote traffic monitoring units 2 in a select area or areas and monitor traffic at only specific points within the city.

During set up of the remote traffic monitoring units, 2 a traffic engineer may use the input device 19 to provide the appropriate user defined data regarding the remote traffic monitoring unit 2, such as the location of the device, date of installation, and the installer's name. This data is stored by the processor 14 as described above.

By way of example, the operation of the remote traffic monitoring unit 2 will be described. In the example, the remote traffic monitoring unit 2 has been set up adjacent to a roadway to monitor motor vehicle traffic, temperature, and water level as illustrated in FIG. 2. Additionally, the object sensing device 11 is a pressure sensitive monitoring strip. The pressure sensitive monitoring strip is stretched across a roadway connected to the counter 13 on one end and secure by a road spike at the other end. When a motor vehicle passes over the monitoring strip 11 a signal is sent to the counter. The counter 13 receives the signal and increments the count data by one. The count data is read by the processor 14. Depending on the application, the processor 14 can continually read the count data or can periodically read the count data.

Once the processor has the count data, the processor 14 stores the information in a predetermined internal register or in an external memory location. In another embodiment, the remote traffic monitoring unit 2 may have multiple object sensing devices and multiple counters. In this embodiment, the processor 14 receives and stores count data from each counter and keeps track of the counter associated with each count data.

The processor 14 also reads temperature, water level, and other sensor data and stores this data in predetermined storage locations.

The processor 14 compiles all of the user defined data and non-user defined data into fields as described and shown in Table 1 and Table 2 above in an SMS message for forwarding to the transceiver 17. Depending on the application, the processor 14 forwards an SMS message to the transceiver 17 at predetermined periodic time intervals, predetermined count intervals, or when requested by the transceiver 17.

In one embodiment, the transceiver 17 is a GMS type PCS transceiver. Depending on the application, the transceiver 17 transmits the SMS message at periodic time intervals, periodic count intervals, or when requested by the central monitoring server 3.

System Operation

One embodiment of the system and its operation is described below. As explained in the above, the transceiver 17 of the remote traffic monitoring unit 2 transmits an SMS message. Turning to FIG. 1, the SMS message is sent from the transceiver 17 (of FIG. 2) to the base station 4. The base station 4 forwards the SMS message to the MSC 5. The MSC 5 recognizes the SMS message as being in SMS format and forwards the message to the SC 6. The SC 6 reformats the SMS message and sends its through the MSC 5 to the PSTN 8. The SMS message is reformatted to the application protocol required by the software on the central computer. The reformatted SMS data message is routed through the PSTN 8 to the central computer 3. The SC 6 will send the transceiver 17 of the remote traffic monitoring unit 2 a confirmation that the reformatted SMS message arrived at the central computer 3 after the central computer sends an acknowledgment to the SC 6.

In one embodiment, the central computer 3 is a personal computer and receives the data messages from the PSTN 8 via a modem. The central computer 3 can process the reformatted SMS message received from the remote traffic monitoring unit 2 in a variety of ways. The treatment of the raw count data is handled by the central computer 3 through the use of a user defined algorithm. For instance, if a pressure sensitive strip is used as the object sensing device 11, a two axle vehicle would cause the count data to be increased by two and the raw count data would not reflect the number of vehicles. User defined algorithms are used by the central computer to convert the raw count data received by the counter into a reflection of the number of vehicles monitored.

The monitored data can be stored by the central computer 3 to provide a record of the traffic flow monitored by the remote traffic monitoring unit 2. Additionally, if the monitored data is near real time data, the central computer 3 can provide this data for immediate dissemination to provide a near real time traffic report, or presentation on a Graphic User Interface ("GUI") terminal either locally or remotely connected to the central computer 3. The GUI terminal could present the near real time traffic flow as a representation on a city street or highway map.

The central computer 3 can also send messages to the remote traffic monitoring unit 2. Such messages would be SMS messages and could provide instructions for the remote traffic monitoring unit 2 to reset and clear the monitored information from the storage locations or the counters 13.

EXAMPLE

Figure 3:
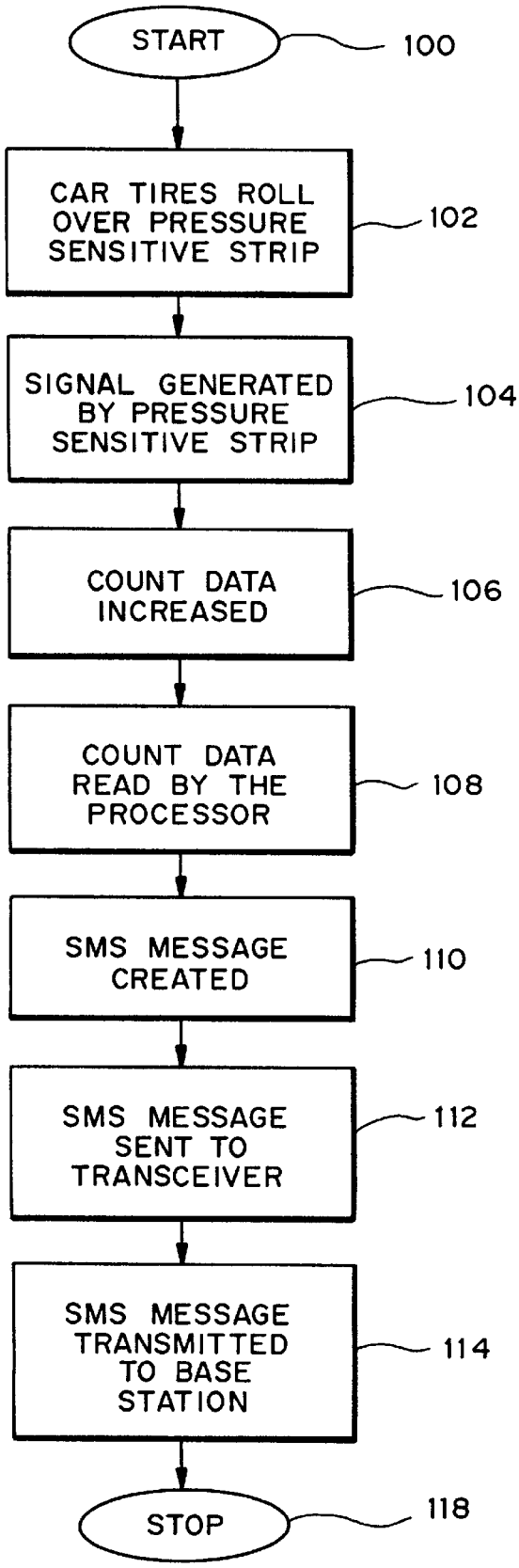
FIG. 3 shows a flowchart of one example of the remote monitoring unit operation.

Turning now to FIG. 3, a flow chart of one example of the remote monitoring unit 2 operation is illustrated. At step 102, car tires roll over the pressure sensitive strip. In turn, in step 104, a signal is generated by the pressure sensitive strip indicating the presence of the car tires. This signal is sent to the counter 13 and the count data in the counter 13 is increased. The processor 14 reads the count data from the counter 13 to obtain the current count data at step 108. In the example, the processor 14 continually reads the count data from the counter 13. After the processor 14 receives the count data, the count data is placed in a register in the processor 14. At step 110, the processor 14 creates an SMS message that includes the count data. The SMS message also contains data identifying the remote monitoring unit and other data as shown in Table 1 and Table 2 above. The processor 14 then sends the SMS message to the transceiver 17, at step 112. In the example illustrated in FIG. 3, the processor 14 sends the SMS message to the transceiver at a predetermined time interval. At step 114, the transceiver 17 transmits the SMS message to the base station 4.

Figure 4:
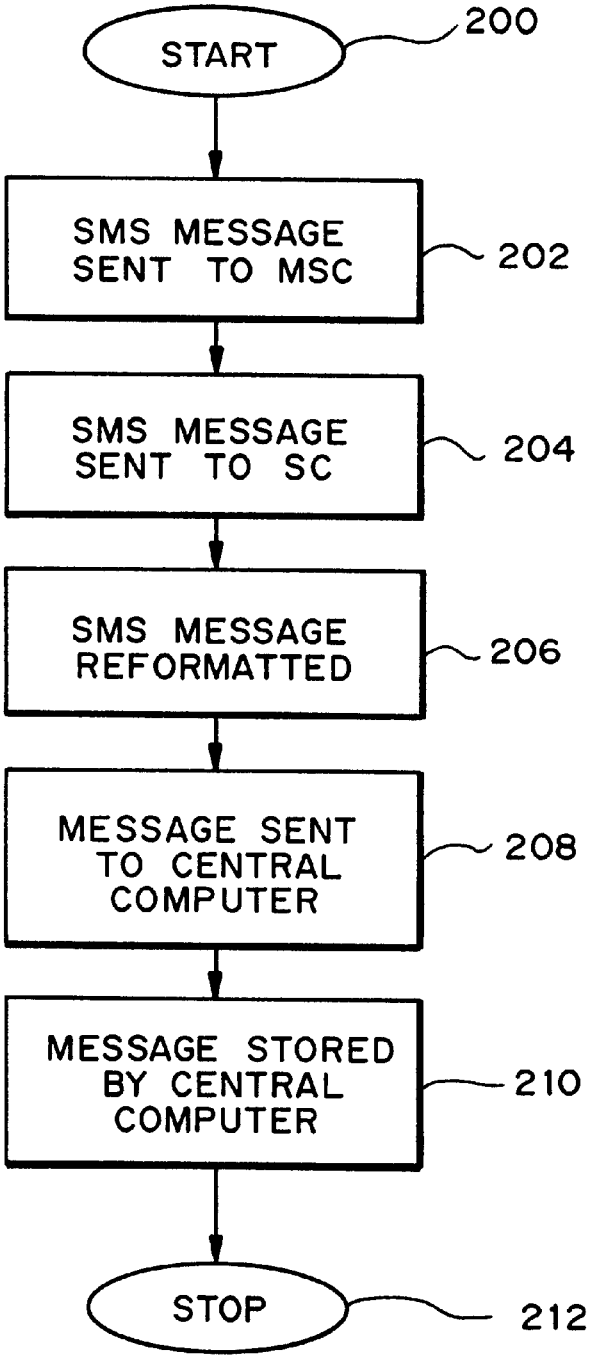
FIG. 4 shows a flowchart of one example of the system operation after the remote monitoring unit transmits a short message service message.

FIG. 4 is a flow chart illustrating one example of the system operation after the SMS message has been transmitted to the base station 4. At step 202, the SMS message is sent to the MSC 5 from the base station 4. The MSC 5, in step 204, sends the message to the SC. The SC reformats the SMS message in step 206. At Step 208, the SC transmits the reformatted message to the central computer through the PSTN. At step 210 the reformatted message is stored by the central computer. Once the central computer has the count data and other data from the remote monitoring unit, the central computer can process the data in a variety of ways as determined by the specific requirements of the system.

The foregoing is provided for purposes of explanation and disclosure of preferred embodiments of the present invention. For instance, a preferred embodiment of this invention involves using a GSM network with short messaging service capability. It is expected that such capabilities or their equivalent will be provided in other standard types of wireless networks, in which case the preferred embodiment of this invention may be easily adapted for use in such networks. Further modifications and adaptations to the described embodiments will be apparent to those skilled in the art and may be made without departing from the scope or spirit of the invention and the following claims.

What is claimed is:

1. A remote traffic monitoring device for use with a wireless network, having a control channel, comprising:

a) a first object sensing device adapted to generate a signal representing the presence of the object;

b) a first counting device coupled to the object sensing device, the counting device adapted to maintain count data, receive the signal representing the presence of the object from the sensing device, and increment the count data for each signal received from the sensing device;

c) a processor coupled to the counting device, the processor adapted to receive the count data from the counting device and format count data and data identifying the device in a short message service message; and d) a messaging transceiver coupled to the processor, the transceiver adapted to receive the short message service message from the processor and transmit the short message service message over the control channel of the wireless network.

2. The remote traffic monitoring device of claim 1, further comprising a temperature sensing device electrically coupled to the processor, the temperature sensing device adapted to generate temperature data.

3. The remote monitoring device of claim 2, wherein the temperature data is assembled in the short message service message with the count data.

4. The remote traffic monitoring device of claim 1, further comprising a water level sensing device electrically coupled to the processor, the water level sensing device adapted to generate water level data.

5. The remote monitoring device of claim 4, wherein the water level data is assembled in the short message service message with the count data.

6. The remote traffic monitoring device of claim 1, further comprising an interface electrically coupled to the processor for connecting an input device to the processor.

7. The remote traffic monitoring device of claim 1, wherein the processor stores the count data in a predetermined storage location.

8. The remote traffic monitoring device of claim 1, wherein the transceiver is a Personal Communication System transceiver.

9. The remote monitoring device of claim 1 wherein the short message service message includes error detection data regarding the function of the remote monitoring device.

10. The remote monitoring device of claim 1 further comprising a power supply coupled to the first counting device, the processor, and the wireless telephone transceiver.

11. A system for maintaining count data of traffic at a remote location and capable of collecting the count data, the system comprising:

a) a remote traffic monitoring device adapted to gather traffic count data, format the traffic count data and data identifying the device into a short message service message, and transmit the short message service message via a control channel on a wireless network; and b) a central computer for receiving the traffic count data from the remote traffic monitoring device.

12. The system of claim 11, where in the central computer can send control information to the remote traffic monitoring device.

13. A method for collecting traffic count data within a system having a remote traffic monitoring device and a central computer, comprising:

a) sensing the presence of an object to be counted;

b) generating a signal representative of the sensing of the object;

c) incrementing traffic count data upon the detection of the signal;

d) formatting traffic count data and data identifying the device into a short message service message format; and e) transmitting the short message service message via a control channel on a wireless network and a public switched telephone network to the central computer.

14. The method of claim 13 wherein the short message service message contains error detection data regarding the function of the remote monitoring device.

15. The method of claim 13 further comprising programming the remote traffic monitoring device.

16. The method of claim 13, further comprising transmitting a message from the central computer to the remote traffic monitoring device.

17. The method of claim 13, further comprising storing the count data at the remote monitoring device.

18. The method of claim 13, further comprising sensing a ambient temperature at the remote monitoring device; generating ambient temperature data representative of the roadway temperature conditions; and formatting the temperature data into the formatted short message service message.

19. The method of claim 13, further comprising transmitting the short message service message to the central computer.

20. The method of claim 13, further comprising sensing ambient road conditions and quality as determined by monitoring moisture level for transmittal in the short message service message.

21. The method of claim 13, further comprising transmitting the short message service message to the central computer.

22. The method of claim 13 wherein the short message service message is transmitted to the central computer after predetermined time period.

23. The method of claim 13 wherein the short message service message is transmitted to the central computer at the request of the central computer.

24. The method of claim 13 wherein the short message service message is transmitted to the central computer when the count data reaches a predetermined number.

* * * * *